US009814958B1

(12) United States Patent
Orenstein et al.

(10) Patent No.: US 9,814,958 B1
(45) Date of Patent: Nov. 14, 2017

(54) ADJUSTABLE BATTING TEE

(71) Applicant: The Prophet Corporation, Owatonna, MN (US)

(72) Inventors: Amber Orenstein, Prior Lake, MN (US); Laura Ann Fletcher, Owatonna, MN (US); Brady Scott Whitney, Maquoketa, IA (US)

(73) Assignee: The Prophet Corporation, Owatonna, MN (US)

( * ) Notice: Subject to any disclaimer, the term of this patent is extended or adjusted under 35 U.S.C. 154(b) by 0 days.

(21) Appl. No.: 15/211,867

(22) Filed: Jul. 15, 2016

(51) Int. Cl.
*A63B 71/00* (2006.01)
*A63B 69/00* (2006.01)

(52) U.S. Cl.
CPC ..... *A63B 69/0075* (2013.01); *A63B 69/0002* (2013.01); *A63B 2069/0008* (2013.01)

(58) Field of Classification Search
CPC ..... A63B 69/0075; A63B 69/0002; A63B 2069/0008
USPC ..... 473/417, 422, 453, 420, 45; D21/720, D21/717, 715
See application file for complete search history.

(56) References Cited

U.S. PATENT DOCUMENTS 3,883,138 A 5/1975 Chorey
4,136,869 A * 1/1979 Tassone ..... A63B 69/0075 473/417
4,664,374 A 5/1987 Groves
4,709,924 A 12/1987 Wilson et al.
4,819,937 A * 4/1989 Gordon ..... A63B 69/0075 473/417
5,076,580 A 12/1991 Lang
5,536,004 A * 7/1996 Wiseman ..... A63B 69/0002 473/417
6,663,513 B2 * 12/2003 Howard ..... A63B 69/0002 473/417
7,226,373 B2 * 6/2007 Arenas ..... A63B 69/0002 473/417
8,257,202 B1 9/2012 Stanek
8,414,429 B2 4/2013 Belt
2003/0032506 A1 * 2/2003 Chi ..... A63B 69/0002 473/417

(Continued)

OTHER PUBLICATIONS

Champro Sports®—The Ultimate Batting Tee, https://shop.champrosports.com/p-1148-the-ultimate-batting-tee.aspx,1 page (Publicly known at least as early as Jul. 15, 2016).

(Continued)

*Primary Examiner* — Mitra Aryanpour
(74) *Attorney, Agent, or Firm* — Merchant & Gould P.C.

(57) ABSTRACT

An adjustable batting tee comprising: a base with a lower planar support surface; an outer tube extending from the base, wherein the outer tube includes a hollow core; an inner tube, wherein the inner tube is disposed within the hollow core of the outer tube; and a locking mechanism which locks inner tube relative to the outer tube at one of at least two discrete positions relative to the floor, ground and/or home plate so as to present a ball supporting distal end of the inner tube at one of the discrete heights from the floor, ground and/or home plate. The locking mechanism includes a projection, at least two circularly shaped grooves, and a longitudinal groove in communication with the at least two circularly shaped grooves. A visual indicator is provided to indicate to the user the discrete heights.

20 Claims, 9 Drawing Sheets

(56) References Cited

U.S. PATENT DOCUMENTS

| | | | | |
|---|---|---|---|---|
| 2005/0255945 | A1* | 11/2005 | Green | A63B 69/0002 473/417 |
| 2006/0258485 | A1* | 11/2006 | Bandimere | A63B 69/0075 473/417 |
| 2007/0060418 | A1* | 3/2007 | Arenas | A63B 69/0002 473/417 |
| 2011/0218058 | A1* | 9/2011 | Gangelhoff | A63B 69/00 473/417 |
| 2012/0258822 | A1* | 10/2012 | Harvey | A63B 69/0002 473/417 |
| 2012/0264547 | A1* | 10/2012 | Windsor | A63B 69/0002 473/417 |
| 2014/0274478 | A1* | 9/2014 | Jorgens | A63B 69/0075 473/417 |
| 2014/0302948 | A1* | 10/2014 | Holland | A63B 69/0002 473/417 |
| 2015/0065272 | A1* | 3/2015 | Bond | A63B 69/0075 473/417 |

OTHER PUBLICATIONS

G Tee Batting Tees, https://thegtee.com/, 3 pages (Publicly known at least as early as Jul. 15, 2016).

Gopher Catalog, (front cover, p. 262, rear cover), 3 pages (Fall 2015) (Publicly known at least as early as Jul. 15, 2016).

Gopher Catalog, (front Cover, p. 262, rear cover), 3 pages (2016) (Publicly known at least as early as Jul. 15, 2016).

Rawlings®5-Position Batting Tee Academy, http://www.academy.com/webapp/wcs/stores/servlet/Product_10151_1005_1_3151049_-1?cm_mmc=pla-_-Team+Sports+Baseball+Baseball+Training+Aids+Baseball+Hitting+Aids-_-Google-_-Rawlings+5-Position+Batting+Tee&gclid=CN2Mj4TE2coCFQyPaQodpmIKKg&kwid=productads-plaid%5E160633366878-sku%5E106400707-adType%5EPLA-device%5Ec-adid%5E69707526438, 5 pages (Publicly known at least as early as Jul. 15, 2016).

* cited by examiner

ADJUSTABLE BATTING TEE

BACKGROUND

In baseball, softball, and other sports involving a bat and ball, one of the most difficult skills to master is hitting the ball with the bat. Often times, practicing a swing of the bat at a ball requires at least another individual or a pitching machine to throw, toss or pitch the ball to the player. Whether from another individual or a machine, precise ball placement is a challenge and often inconsistent. Each pitch can vary widely and players struggle to get precise ball placement for a consistent batting practice. It is especially challenging when players want to practice repetitively hitting balls at a certain height, angle, or placement. Batting tees which support a stationary ball are used to train players to hit balls from a specific location relative to the player. Batting tees may be adjustable to allow for different ball locations relative to the player in the vertical direction.

It is with respect to these and other general considerations that aspects of the present disclosure have been made. Additionally, although relatively specific problems are discussed, it should be understood that the aspects should not be limited to solving only the specific problems identified in the background.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the invention is an adjustable batting tee where players can have consistent and precise ball placement during batting practice. An adjustable batting tee is provided as an athletic device used by players to practice hitting balls at various heights, positions, and/or angles. The players can practice their swing technique, swing accuracy, and swing power on balls at various heights, positions, and angles. The adjustable batting tee allows players to practice their swing without a pitcher or pitching machine.

In one aspect, the adjustable batting tee can be set at a certain height position giving coaches and players the ability to create consistent batting routines and practice drills that are easily taught and communicated to other players and other coaches.

In one aspect, the adjustable batting tee can be set at a repeatable height or heights with an adjustable locking mechanism.

In one aspect, the adjustable batting tee can be set at one of at least two discrete height positions, and preferably more than two height positions, giving coaches and players the ability to create consistent and/or repeatable batting routines and practice drills that are easily taught and communicated to players and coaches. Preferably, more than two discrete height positions are provided, such as three, four, five, six, seven, eight, nine, ten and more than ten.

In one aspect, a locking mechanism locks the adjustable batting tee at one of at least two discrete positions relative to the floor, ground and/or home plate so as to present the ball supporting distal end at one of the discrete heights from the floor, ground and/or home plate.

In a another aspect, an adjustable batting tee includes a base with a floor, ground or home plate engaging lower surface; an outer tube extending vertically from the base, wherein the outer tube comprises a hollow core; and an inner tube disposed at least partially within the hollow core of the outer tube, wherein the inner tube is slidable in a telescoping manner relative to outer tube, and wherein the inner tube includes a ball supporting distal end. A locking mechanism locks the inner tube at one a plurality of discrete positions relative to the outer tube so as to present the ball supporting distal end at one of a plurality of discrete heights from the base.

In one aspect, the locking mechanism includes a first horizontal circularly shaped groove disposed along the hollow core of the outer tube at a first height relative to the base, a second horizontal circularly shaped groove disposed along the hollow core of the outer tube at a second height, and at least one linear groove extending perpendicularly relative to the first and second horizontal grooves and in communication with the first and second horizontal grooves. The inner tube includes a locking projection or tip. When the inner tube is disposed within the hollow core of the outer tube, and the projection is located in the linear groove, the inner tube is telescopingly moveable axially relative to the outer tube. When the inner tube is rotated relative to the outer tube about a central axis, such rotation causes the locking tip to be moved from the linear groove and into one of the first or second horizontal grooves to secure the inner tube at the first or second height. Third, fourth, fifth, sixth, seventh, eighth, ninth and tenth or more horizontal grooves are provided in various embodiments.

In one aspect, sets of two horizontal grooves are provided to define a corresponding number of discrete heights of the distal end of the inner tube. In one aspect, more than two sets of horizontal grooves are provided to define a corresponding number of discrete heights of the distal end of the inner tube. In one aspect, at least five sets of horizontal grooves are provided. In another example, at least 10 sets of horizontal grooves are provided. In one aspect, at least 14 sets of horizontal grooves are provided.

In one aspect, two horizontal grooves and stop surfaces are provided for each discrete height of the distal end of the inner tube.

In one aspect, the horizontal grooves are circularly shaped.

In one aspect, two locking tips are provided for each discrete height of the distal end of the inner tube.

In one aspect, a visual indicator is located on the tee to identify the discrete height positions. One visual indicator includes outer rings or indentations on the inner tube that correspond with the discrete heights of the distal end of the inner tube. Other visual indicators can be used, such as printed or molded indicia including letters, numbers, lines, ribs, or other structures.

The discrete positions of the inner tube relative to the outer tube allow for repeatable placement at the selected, discrete height. The locking mechanism maintains the selected height during use of the tee, whereby the user does not need to reset the selected height during the hitting drill or drills. Selecting a new height is convenient for the user by unlocking the locking mechanism and relocking at the new selected height. The tee can easily be used by different players at their desired height or heights. The tee can be used over time by the same player at their selected height or heights.

DETAILED DESCRIPTION

Figure 1:
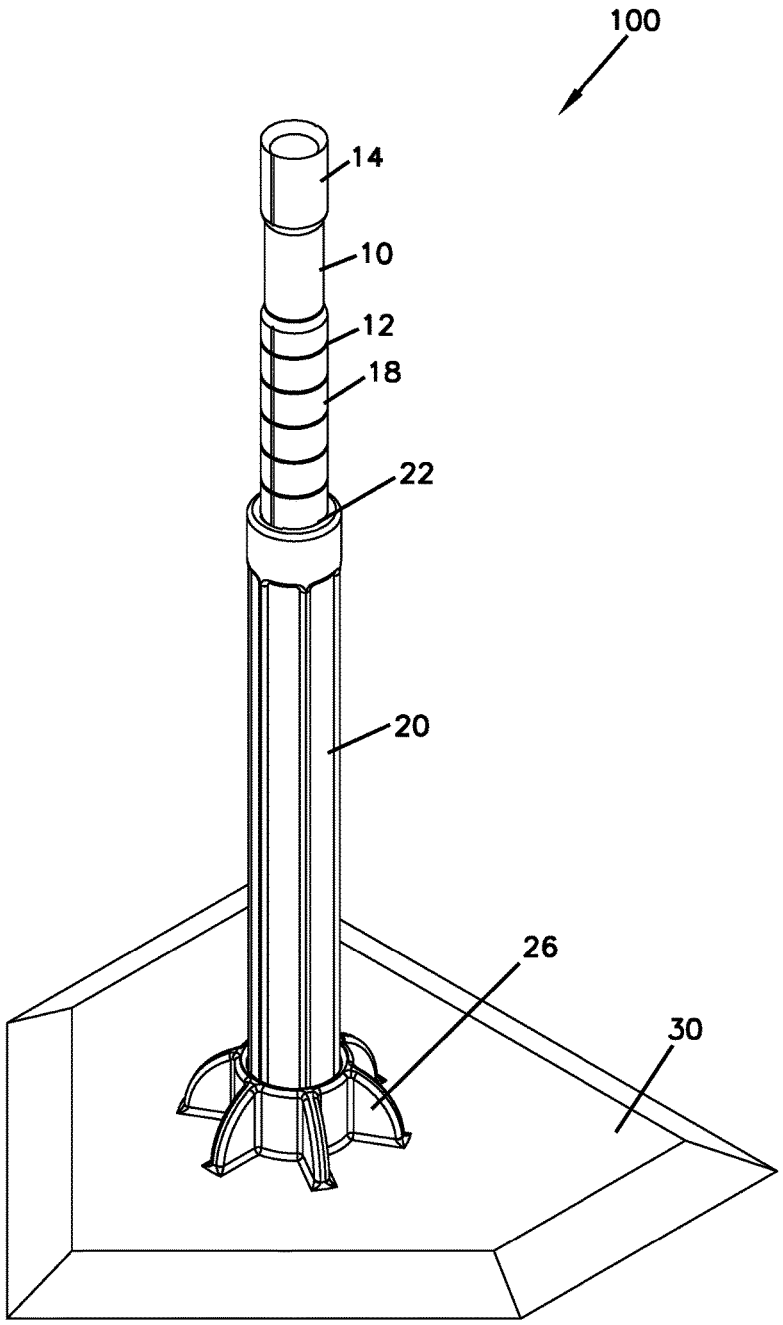
FIG. 1 illustrates a perspective view of the adjustable batting tee.
Figure 2:
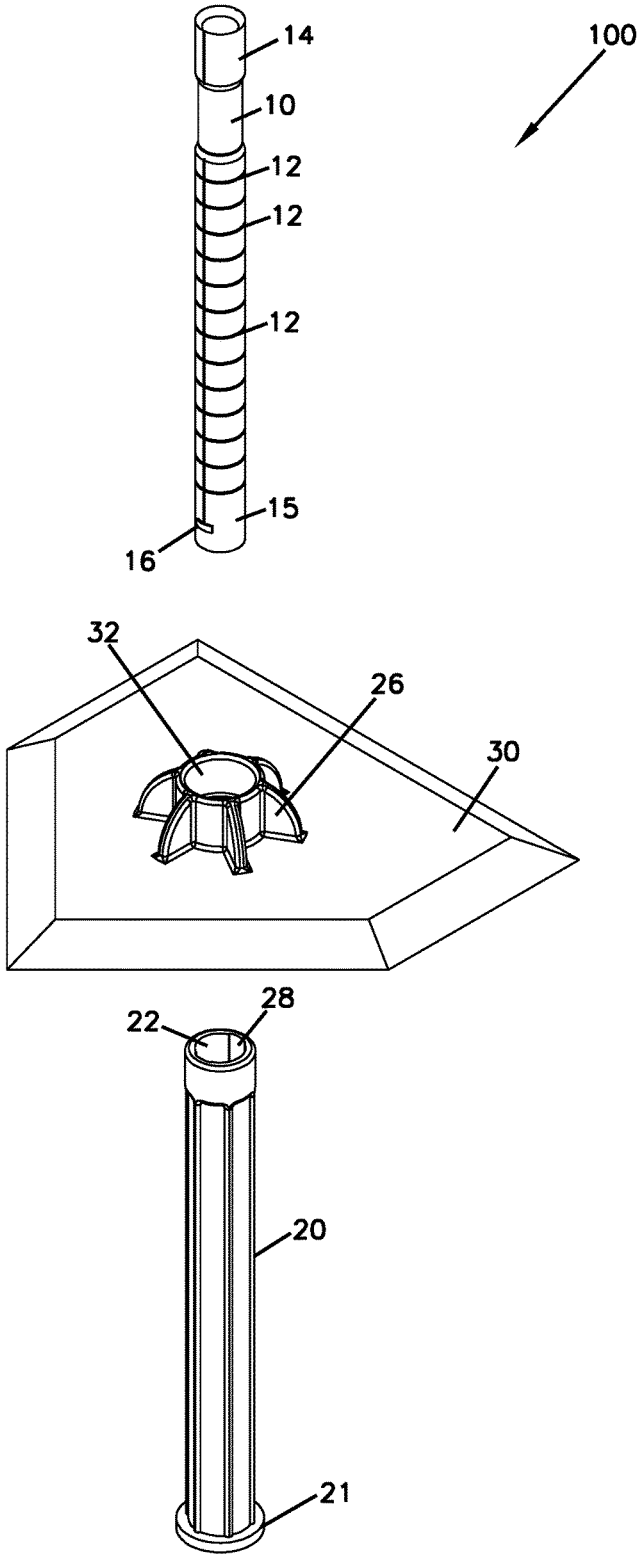
FIG. 2 illustrates a perspective view of the adjustable batting tee in exploded view.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Aspects of the disclosure provide an adjustable batting tee including an inner tube with a proximal end located inside the hollow core of an outer tube. Both the outer tube and inner tube can be formed of a flexible material and/or have a flexible/movable connection, which enables the inner tube to be positioned vertically through the hollow core of the outer tube. For example, the inner tube can be positioned at a high position within the outer tube so as to replicate high pitches. The inner tube can also be positioned at a low position within the outer tube so as to replicate low pitches.

Positions between the high position and the low position can be provided as desired.

The inner tube can be locked into discrete height positions, by a locking mechanism, and each discrete height position corresponds to the height positions of a visual indicator and a locking mechanism between the inner tube and outer tube, respectively. The discrete positions are repeatable as desired.

Referring to FIGS. 1 through 10, an adjustable batting tee 100 includes an inner tube 10, an outer tube 20, and a base 30. In this embodiment, the outer tube 20 includes a hollow core 22, which is of a sufficient size to receive a proximal end 15 of the inner tube 10. The inner tube 10 also includes a shaft 18 and a distal end 14. Distal end 14 supports the ball. Inner tube 10 also includes horizontal rings 12 and two locking tips 16, which together are used to secure inner tube 10 at discrete height positions within the hollow core 22 of outer tube 20. The outer tube 20 has a series of horizontal grooves 24 within the hollow core 22 and each horizontal groove 24 is set at discrete height positions. Within the hollow core 22 of the outer tube 20, there is at least one linear or longitudinal groove running along the height of the outer tube 20 and is perpendicular to and in communication with the horizontal grooves 24. At one end of adjustable batting tee 100 is an anchor end 26. The anchor end 26 allows the outer tube 20 to be secured onto the base 30 by inserting the outer tube 20 through the bottom of base 30. Base 30 serves as an anchor to keep the adjustable batting tee 100 in place after each use and helps prevent movement of the adjustable batting tee 100 after incidental contact with a player's bat. As described herein, the inner tube 10 is sized to be telescopingly received within the hollow core 22 of the outer tube 20. Outer tube 20 includes a flange 21 which is larger than opening 32 in base 30. Base 30 defines a planar lower surface for resting on the floor, ground or on home plate as desired. Both the inner tube 10 and the outer tube 20 generally define circular cross-sections.

Figure 3:
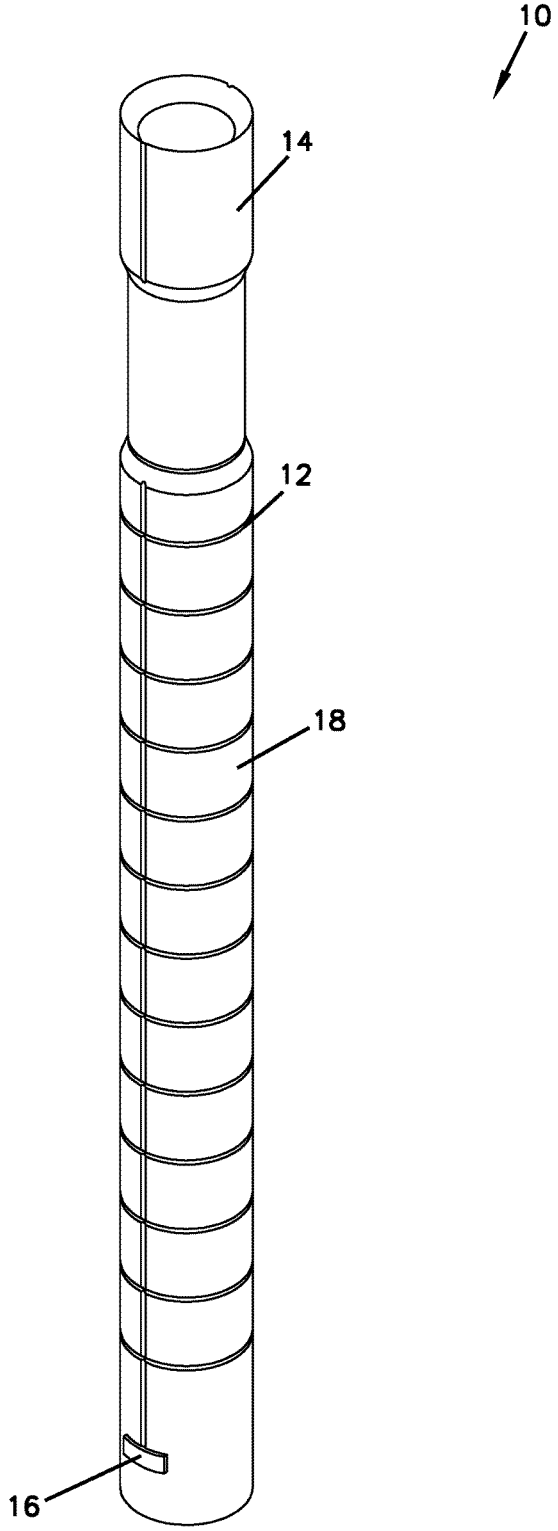
FIG. 3 illustrates a perspective view of the inner tube.

FIG. 3 illustrates a perspective view of the inner tube 10. In this exemplary embodiment, the inner tube 10 includes a shaft 18, a distal end 14, two opposed locking tips 16 and a series of rings 12 at discrete height positions. Rings 12 define indentions in the exterior of the inner tube 10. Distal end 14 supports the ball. Distal end 14 is shown as an open end where the ball rests on the end as the player swings the ball to hit the ball. Rings 12 and locking tips 16 are used to secure inner tube 10 at desired discrete height positions within the hollow core 22 of outer tube 20. Rings 12 are circularly shaped.

Rings 12 create a visual indicator feature for the player or coach. The number of rings can be counted and/or labeled so that the player can use tee 100 at the same height or heights over time during the same practice session or at different practice sessions.

As illustrated in FIG. 3, the inner tube 10 has a series of rings 12 and each ring 12 is set at discrete height positions along the shaft 18 of inner tube 10. The position of each ring 12 corresponds with the discrete height position where the inner tube 10 can be securely locked within the hollow core 22 of the outer tube 20. At one end of the inner tube 10 are locking tips 16. Locking tips 16 protrude from the inner tube 10 and are shaped to fit securely into the horizontal grooves 24 in the hollow core 22 of the outer tube 20. Together, the locking tips 16 and grooves 24 secure the inner tube 10 at a discrete height position within the hollow core 22 of the outer tube 20. Furthermore, the other end of the inner tube 10 comprises a distal end 14. The distal end 14 is configured to support a ball. For example, the distal end 14 has a sufficiently convex shape, and/or an open shape to support balls of varying sizes such as a baseball, a softball, or a variety of other sport balls. In an embodiment, the distal end 14 may be modular and detachable, allowing a player to secure distal ends of varying sizes depending on the desired ball shape and size to be used. In another embodiment, inner tube 10 is formed of a material having sufficient stiffness to support the weight of the ball on the distal end 14 and yet having sufficient flexibility to withstand the contact of repeated bat swings by a player without damage. It is understood that the material forming the inner tube 10 is constructed to withstand repeated use as the environment for use may include professional teams or training institutions where players are expected to use take multiple swing repetitions using the adjustable batting tee. Inner tube 10 may be made from materials such as rubber, silicone, plastic, or other flexible polymer material. As described herein, the outer tube 20 is sized to hold the inner tube 10 within the hollow core of the outer tube 20, the inner tube 10 being telescopingly received within the hollow core 22 of the outer tube 20. In the example, two tips 16 are provided, and two horizontal grooves 24 are provide at each discrete height, wherein a tip 16 is received in each groove 24 at the selected discrete height. Each horizontal groove 24 includes a stop shoulder 34, to prevent further rotation in the locked position of the inner tube 10 relative to the outer tube 20. Each groove 24 is circularly shaped.

Figure 4:
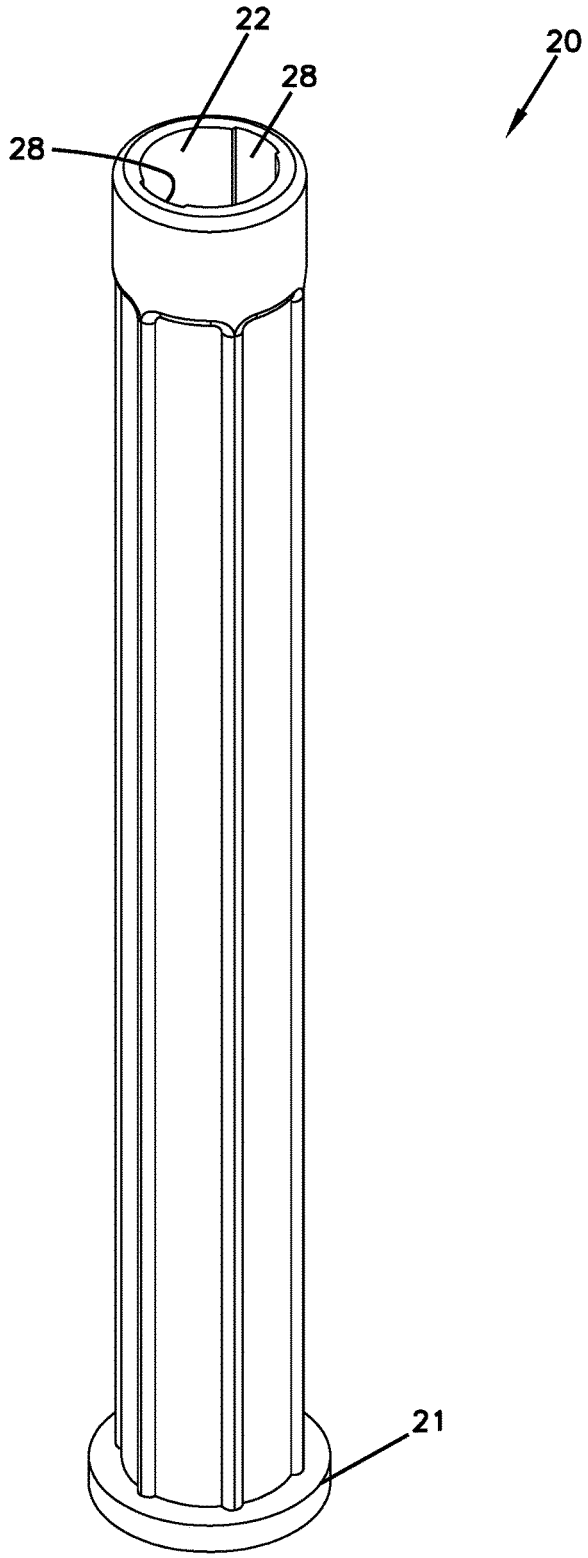
FIG. 4 illustrates a perspective view of the outer tube.

FIG. 4 illustrates a perspective view of the outer tube. In this exemplary embodiment, the outer tube 20 includes a shaft, a hollow core 22, longitudinal groove 28, and a series of horizontal grooves 24 at discrete height positions. The rings 12 as a visual guide and locking tips 16 of the inner tube 10 are used to secure inner tube 10 at discrete height positions within the hollow core 22 of outer tube 20. In one embodiment, the outer tube 20 is formed of a material having a sufficient stiffness to support the weight of the inner tube 10 and the outer tube 20 but also having sufficient flexibility to withstand repeated swings by a player. It is understood that the material forming the outer tube 20 is constructed to withstand repeated use as the environment for use may include professional teams or training institutions where players are expected to use take multiple swing repetitions using the adjustable batting tee. Outer tube 20 may be made from materials such as rubber, silicone, plastic, or other flexible polymer material.

Figure 5:
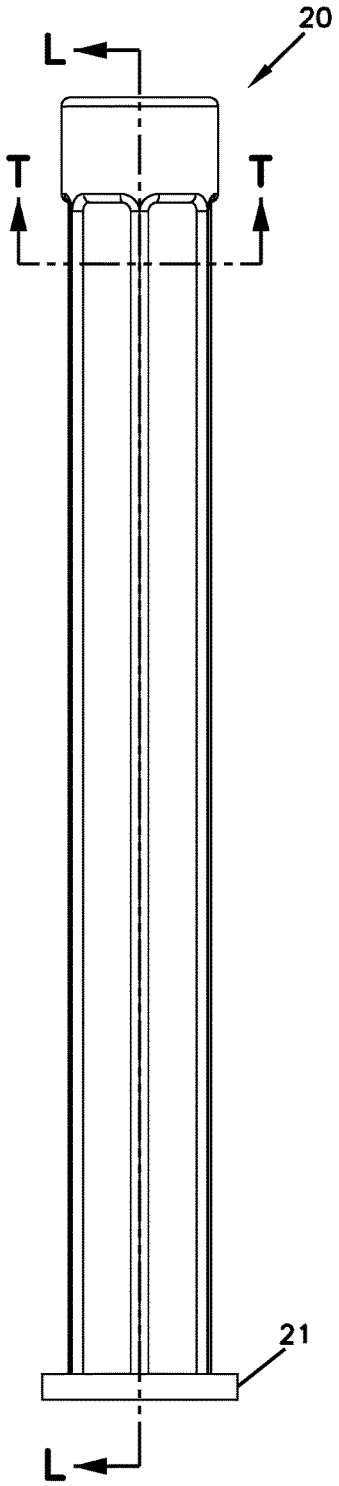
FIG. 5 illustrates a side elevational view of the outer tube.
Figure 6:
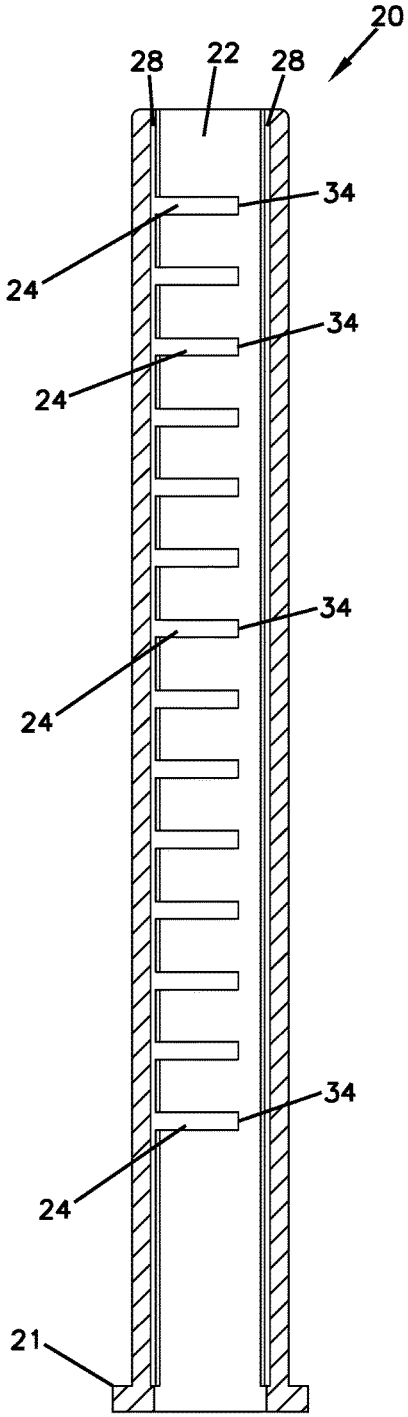
FIG. 6 illustrates a cross-sectional view of the outer tube taken along a vertical or longitudinal direction L-L.
Figure 7:
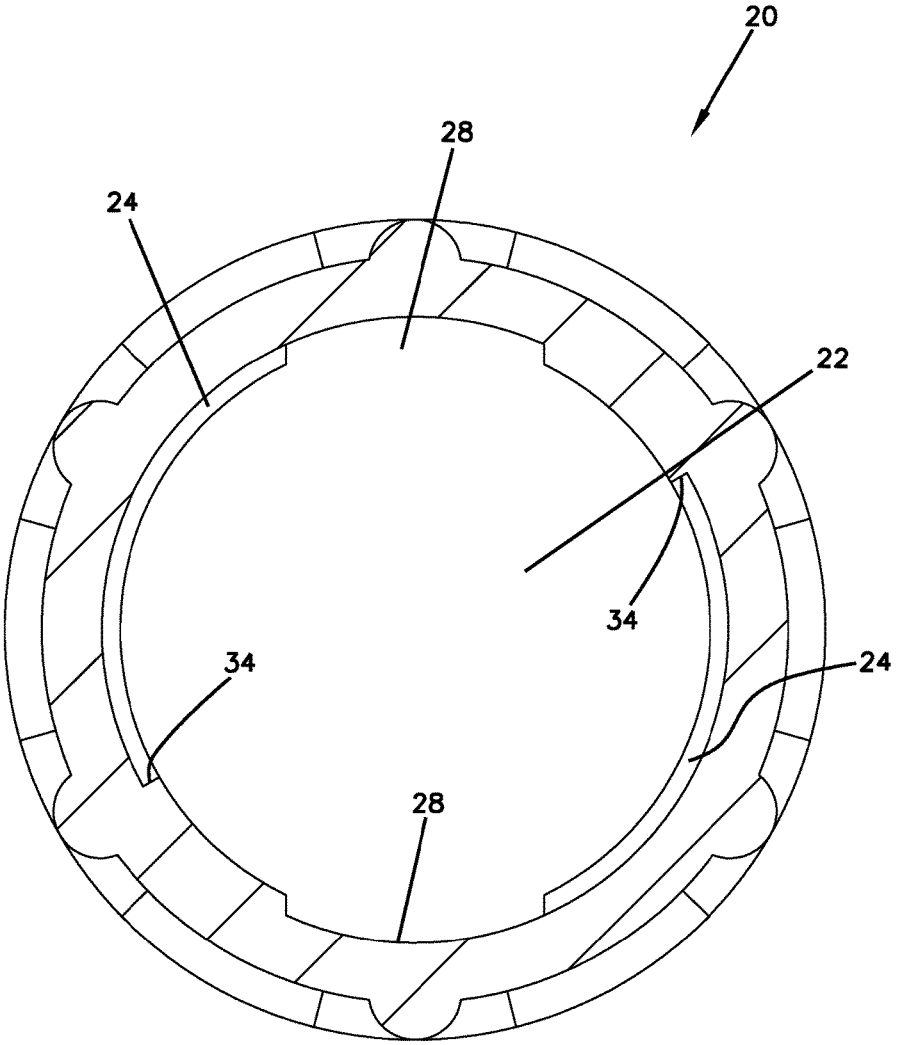
FIG. 7 illustrates a transverse cross-sectional view of the outer tube taken along a horizontal or transverse direction T-T.

FIG. 5 illustrates a side view of the outer tube 20. FIG. 6 is cross-sectional view of the outer tube 20 taken along the longitudinal direction L-L. FIG. 7 is a transverse cross-sectional view of the outer tube 20 taken along the transverse direction T-T.

FIG. 5 illustrates a side view of the outer tube 20. The longitudinal direction is noted by the dashed line L-L. The transverse direction is noted by the dashed line T-T.

FIG. 6 illustrates a cross-sectional view of the outer tube 20 taken along the longitudinal direction L. In this embodiment, the outer tube 20 has a series of horizontal grooves 24 and each horizontal groove 24 is set at discrete height positions along the hollow core 22 of the outer tube 20. There are higher vertically positioned horizontal grooves and lower vertically positioned horizontal grooves. Each horizontal groove 24, whether high or low, corresponds with each of the rings 12 of the inner tube 10. The horizontal grooves 24 are molded to securely hold the locking tips 16 of the inner tube 10. The outer tube 20 also has at least one longitudinal groove 28 running along the height of the tube and is perpendicular to the horizontal grooves 24. The longitudinal groove 28 allows the inner tube 10 to be repositioned vertically within the hollow core 22 of the outer tube 20 to change the height of distal end 14.

FIG. 7 illustrates a transverse cross-sectional view of the outer tube 20. In this exemplary embodiment, the outer tube 20 includes a shaft, a hollow core 22, longitudinal groove 28, and a series of horizontal grooves 24 at discrete height positions. Each horizontal groove 24 is set at discrete height positions along the hollow core 22 of the outer tube 20. The rings 12 and locking tips 16 of the inner tube 10 are used to secure inner tube 10 at discrete height positions within the hollow core 22 of outer tube 20. The longitudinal groove 28 allows the inner tube 10 to be repositioned vertically within the hollow core 22 of the outer tube 20.

Figure 8:
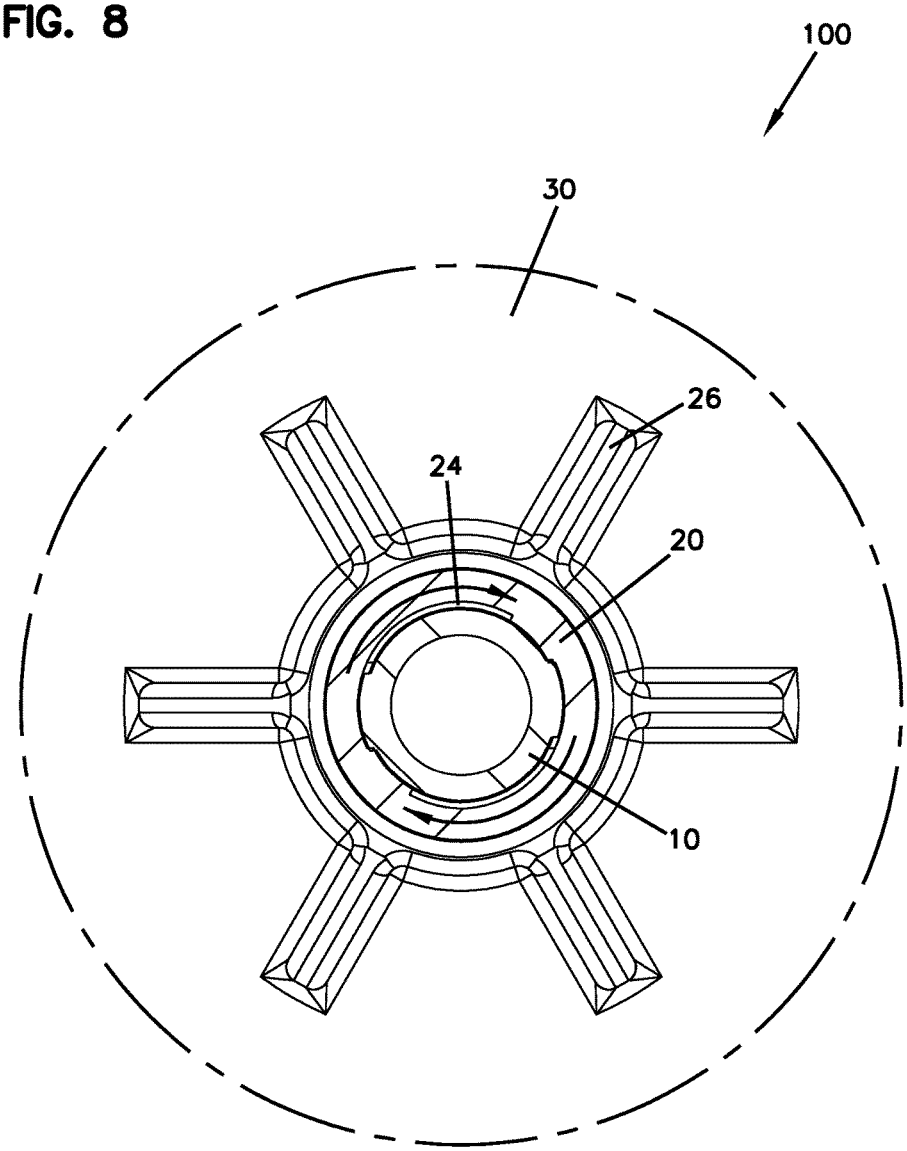
FIG. 8 illustrates a transverse cross-sectional view of the adjustable batting tee.

FIG. 8 illustrates a transverse cross-sectional view of the adjustable batting tee 100. In this embodiment, the inner tube 10 is positioned within the outer tube 20. At one end of adjustable batting tee 100 is an anchor end 26. The anchor end 26 allows the outer tube 20 to be secured onto the base 30. Base 30 serves as an anchor to keep the adjustable batting tee 100 in place after each use and helps prevent movement of the adjustable batting tee 100 after incidental contacts with a player's bat. Even if the tee falls over, the player can easily replace the base 30 on the floor, ground or home plate. The outer tube 20 includes a shaft, a hollow core 22, longitudinal groove 28, and a series of horizontal grooves 24 at discrete height positions. The rings 12 and locking tips 16 of the inner tube 10 are used to secure inner tube 10 at discrete height positions within the hollow core 22 of outer tube 20. The inner tube 10 is secured by rotating the shaft 18 of the inner tube in a rotational direction within the hollow core 22 of the outer tube 20. The inner tube 10 is released for movement by rotating in the opposite direction.

Figure 9:
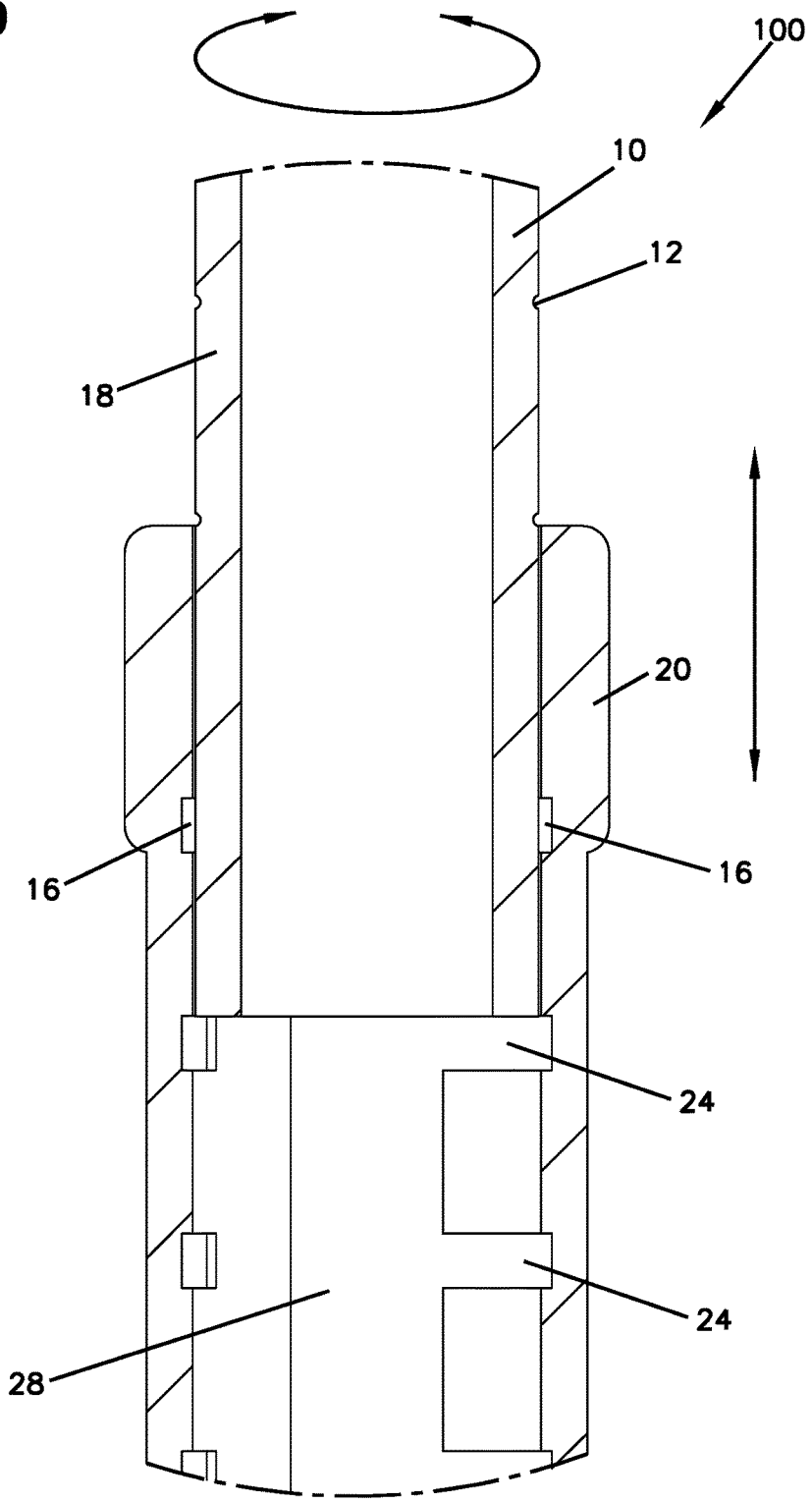
FIG. 9 illustrates a longitudinal cross-sectional view of the adjustable batting tee.

FIG. 9 illustrates a longitudinal cross-sectional view of the inner tube 10 at a position within the outer tube 20. In this embodiment, the outer tube 20 includes a hollow core 22, which houses the inner tube 10. The inner tube 10 includes a shaft 18, rings 12, and locking tips 16. The outer tube 20 includes a shaft, a hollow core 22, longitudinal groove 28, and a series of horizontal grooves 24 at discrete height positions. As described herein, the inner tube 10 is sized to be telescopingly received within the hollow core 22 of the outer tube 20.

In an embodiment, the inner tube 10 can be adjusted to varying heights within the hollow core 22 of the outer tube 20. The inner tube 10 has a series of rings 12 and each ring 12 is set at discrete height positions along the inner tube 10. Similarly, the outer tube 20 has a series of horizontal grooves 24 within its hollow core 22 and each horizontal groove 24 is set at discrete height positions along the hollow core 22. To lock the inner tube 10 at a desired height position, the inner tube 10 is telescopingly received within the hollow core 22 of the outer tube 20 along the longitudinal groove 28 and the locking tips 16 engages with the horizontal groove 24. In an embodiment, the locking tips 16 align, rotate, and engage within the recesses of the horizontal grooves 24, thereby securing the inner tube 10 and locking the inner tube 10 at a discrete height position. It is understood that the locking tips 16 complement the horizontal grooves 24; for example, the locking tips 16 can be rotated along and within the horizontal grooves 24 and stopped by stop shoulder 34. The locking tips 16 protrude into the recess of the horizontal groove 24, the recess of the horizontal groove 24 thereby provide frictional support and prohibit the locking tips 16 from being displaced vertically within the hollow core 22 of the outer tube 20.

Figure 10:
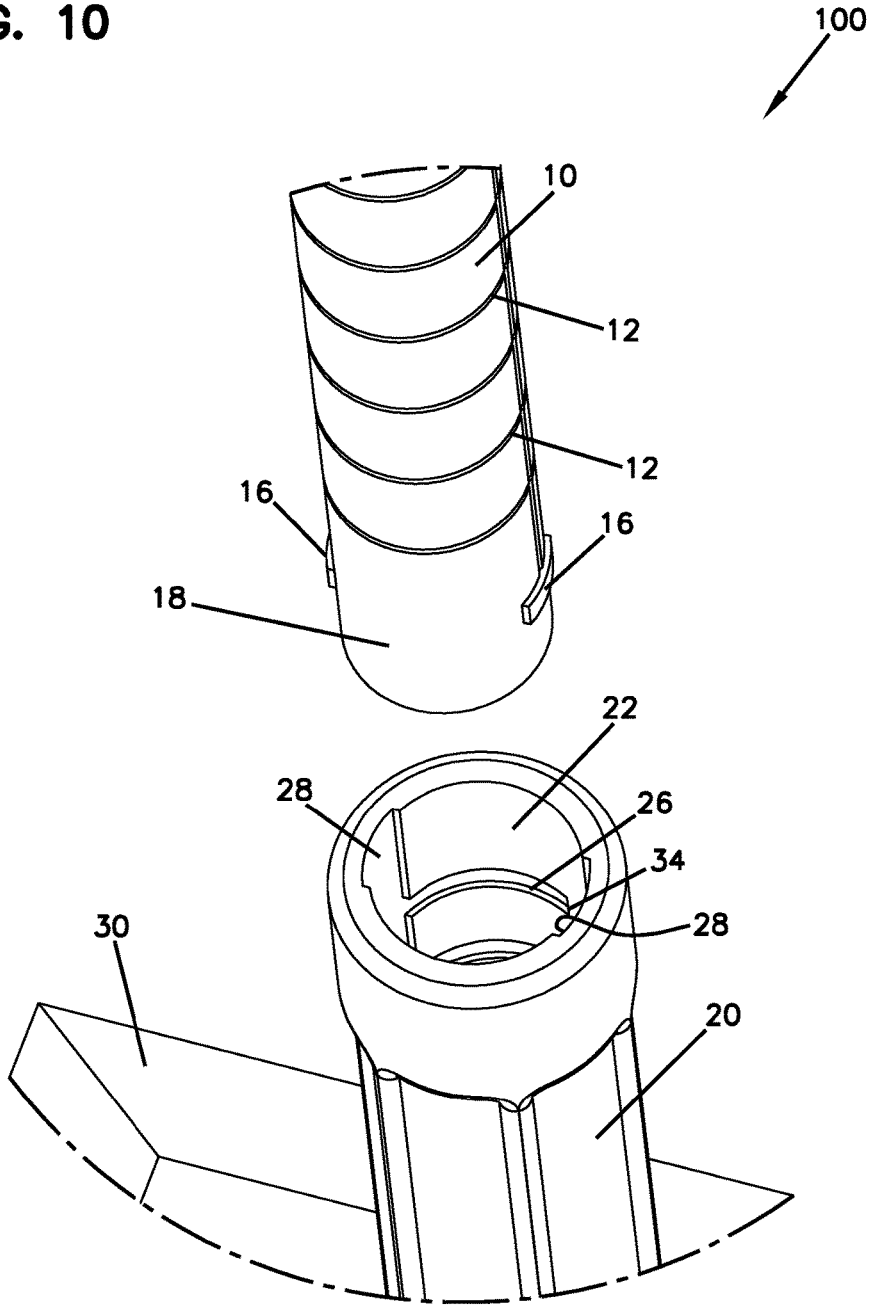
FIG. 10 is a perspective view of a portion of the adjustable batting tee in exploded view showing the locking tips, longitudinal grooves, and horizontal grooves.

FIG. 10 is a perspective view of the adjustable batting tee 100. In this embodiment, the outer tube 20 includes a hollow core 22, which houses the inner tube 10. The inner tube 10 also includes a shaft 18, rings 12, and locking tips 16. The rings 12 and locking tips 16 are used to secure inner tube 10 at discrete height positions desired by the user within the hollow core 22 of outer tube 20. As described herein, the inner tube 10 is sized to be telescopingly received within the hollow core 22 of the outer tube 20.

As illustrated in FIG. 10, the inner tube 10 can be adjusted to varying heights within the hollow core 22 of the outer tube 20. The inner tube 10 has a series of rings 12 and each ring 12 is set at discrete height positions along the inner tube 10. Similarly, the outer tube 20 has a series of horizontal grooves 24 within its hollow core 22 and each horizontal groove 24 is set at discrete height positions along the hollow core 22. In one embodiment, the horizontal grooves 24 terminate at a locking point and do not form a continuous groove around the circumference of the hollow core 22. This prevents the inner tube 10 from accidental rotation when incidentally hit with a bat. To lock the inner tube 10 at a desired height position, the inner tube 10 is telescopingly received within the hollow core 22 of the outer tube 20 along the longitudinal groove 28 and the locking tips 16 engages with the horizontal groove 24. In an embodiment, the locking tips 16 align, rotate, and engage within the horizontal grooves 24, thereby securing the inner tube 10 and locking the inner tube 10 at a discrete height position. It is understood that the locking tips 16 complement the horizontal grooves 24; for example, the locking tips 16 can be rotated along and within the horizontal grooves 24. The locking tips 16 protrude into the recess of the horizontal groove 24, the recess of the horizontal groove 24 thereby provide frictional support and prohibit the locking tips 16 from being displaced vertically within the hollow core 22 of the outer tube 20.

The locking mechanism allows for repeated uses by the player without the inner tube 10 slipping relative to outer tube 20, wherein the same discrete is maintained until the player or coach changes the tee 100 to a new discrete height.

The visual indicator including rings 12 is a preferred structure to provide information to the user. In one use, the indicator allows the user to repeat a drill or follow a drill instruction for hitting at a particular height. The visual indicator helps the user find the horizontal grooves with the tips since these are internal structures not typically visible to the user.

Other visual indicators can be used, such as printed or molded indicia including letters, numbers, lines, ribs, or other.

What is claimed is:

1. An adjustable batting tee comprising:
a base with a lower support surface;
an outer tube extending from the base, wherein the outer tube includes:
a hollow core;
a first horizontal groove disposed along the hollow core at a first height from the base;
a second horizontal groove disposed along the hollow core at a second height from the base; and
at least one longitudinal groove running perpendicular to the first and second horizontal grooves;
an inner tube with a locking tip, wherein the inner tube is disposed at least partially within the hollow core of the outer tube.

2. The adjustable batting tee of claim 1, wherein the inner tube is telescopingly received within the outer tube, and the inner tube, when telescoped, causes the locking tip to:
insert into the first horizontal groove; and
secure the inner tube at the first height.

3. The adjustable batting tee of claim 1, wherein the inner tube further comprises a plurality of outer rings.

4. The adjustable batting tee of claim 2, wherein the inner tube, when further telescoped, causes the locking tip to:
insert into the second horizontal groove; and
secure the inner tube at the second height.

5. The adjustable batting tee of claim 1, wherein the inner tube further comprises a flexible end with a ball support.

6. The adjustable batting tee of claim 1, further comprising an anchor end that attaches the outer tube to the base.

7. The adjustable batting tee of claim 3, wherein the plurality of outer rings correspond to discrete height intervals.

8. The adjustable batting tee of claim 1, wherein the first horizontal groove terminates at a first locking point and the second horizontal groove terminates at a second locking point.

9. The adjustable batting tee of claim 1, further comprising a second locking tip and two longitudinal grooves, and a second set of first and second horizontal grooves.

10. An adjustable batting tee comprising:
a base with a lower support surface;
an outer tube, wherein the outer tube includes:
a shaft with a hollow core extending from the base;
a first longitudinal groove;
a second longitudinal groove;
a plurality of horizontal grooves including:
a first horizontal groove extending perpendicular to the first longitudinal groove and disposed along the hollow core at a first height;
a second horizontal groove extending perpendicular to the second longitudinal groove and disposed along the hollow core at the first height;
a third horizontal groove extending perpendicular to the first longitudinal groove and disposed along the hollow core at a second height;
a forth horizontal groove extending perpendicular to the second longitudinal groove and disposed along the hollow core at the second height; and
an inner tube with a pair of locking tips, wherein the inner tube is disposed at least partially within the hollow core of the outer tube, the inner tube is telescopingly received in the outer tube, and the inner tube, when telescoped, causes the pair of locking tips to:
insert into the first and second horizontal grooves; and
secure the inner tube at the first height.

11. The adjustable batting tee of claim 10, wherein the inner tube comprises a plurality of outer rings.

12. The adjustable batting tee of claim 10, wherein the inner tube, when telescoped, causes the pair of locking tips to:
insert into the third and fourth horizontal grooves; and
secure the inner tube at the second height.

13. The adjustable batting tee of claim 10, wherein the inner tube further comprises a flexible end with a ball support.

14. The adjustable batting tee of claim 11, wherein the plurality of outer rings correspond to discrete height intervals.

15. The adjustable batting tee of claim 10, wherein the plurality of horizontal grooves terminate at a plurality of locking points.

16. A method to practice hitting a ball on a batting tee at discrete height positions, comprising:
placing a base on a generally horizontal surface;
providing an outer tube extending from the base, wherein the outer tube includes: a hollow core;
a plurality of horizontal grooves disposed along the hollow core at varying heights;
at least one longitudinal groove extending perpendicular to the plurality of horizontal grooves;
providing an inner tube with a portion inside the outer tube, wherein the inner tube comprises a locking tip, a flexible end with a ball support, and a plurality of outer rings;
aligning the locking tip with the at least one longitudinal groove;
telescoping the inner tube within the outer tube;
rotating the inner tube within the outer tube and locking the inner tube at a desired height.

17. The method of claim 16, wherein rotating the inner tube within the outer tube further comprises rotating the locking tip within one of the plurality of horizontal grooves.

18. The method of claim 16, further comprising positioning a ball onto the ball support.

19. The method of claim 16, further comprising using the plurality of outer rings as discrete height indicators.

20. The method of claim 16, further comprising moving the inner tube to a different desired height by rotating the inner tube in a first direction, longitudinally moving the inner tube to the different desired height, and rotating the inner tube in a second direction opposite to the first direction.

* * * * *